US011274413B2

(12) United States Patent
Breu et al.

(10) Patent No.: US 11,274,413 B2
(45) Date of Patent: Mar. 15, 2022

(54) COUPLER ASSEMBLY FOR COUPLING AN ARM TO A WORK TOOL

(71) Applicant: Caterpillar Inc., Deerfield, IL (US)

(72) Inventors: Christian Breu, Burglengenfeld (DE); Zdenko Savšek, Trbovlje (SI)

(73) Assignee: Caterpillar Inc., Peoria, IL (US)

( * ) Notice: Subject to any disclaimer, the term of this patent is extended or adjusted under 35 U.S.C. 154(b) by 874 days.

(21) Appl. No.: 16/039,709

(22) Filed: Jul. 19, 2018

(65) Prior Publication Data

US 2019/0032301 A1 Jan. 31, 2019

(30) Foreign Application Priority Data

Jul. 25, 2017 (EP) ..... 17182961

(51) Int. Cl.
*E02F 3/36* (2006.01)
*E02F 3/30* (2006.01)
*E02F 9/22* (2006.01)

(52) U.S. Cl.
CPC ..... *E02F 3/302* (2013.01); *E02F 3/308* (2013.01); *E02F 3/3636* (2013.01); *E02F 3/3663* (2013.01); *E02F 3/3645* (2013.01); *E02F 9/2271* (2013.01)

(58) Field of Classification Search
CPC ..... E02F 3/3609; E02F 3/3613; E02F 3/3618; E02F 3/3622; E02F 3/3627; E02F 3/3631; E02F 3/3636; E02F 3/364; E02F 3/3645; E02F 3/3654; E02F 3/3659; E02F 3/3663;
(Continued)

(56) References Cited

U.S. PATENT DOCUMENTS 2,090,342 A * 8/1937 Callsen ..... F02N 7/02 74/89.17
3,288,035 A * 11/1966 Ryzner ..... F15B 15/065 91/467
6,718,663 B1 4/2004 Geraghty
(Continued)

FOREIGN PATENT DOCUMENTS

CN 1273308 11/2000
CN 105179371 12/2015
(Continued)

OTHER PUBLICATIONS

European Search Report for Application No. EP 17182961: search completed on Jan. 26, 2018.

*Primary Examiner* — Saul Rodriguez
*Assistant Examiner* — Brendan P Tighe

(57) ABSTRACT

A coupler assembly for detachably coupling an arm to a work tool. The coupler assembly comprises a first linkage having an idle link and a power link, a first pin provided on the arm, and a second pin provided on the power link. The first and second pins are receivable in openings on the work tool. The coupling assembly is characterized by a second linkage provided between the first and second pins comprising a first link and a second link joined at a shaft. The first link is fixed to the shaft to prevent rotation therebetween. A portion of the shaft comprises a gear. The second link comprises a body mounted on the shaft so as to be rotatable thereabout, the body comprising a chamber in which a piston is received, the piston including a geared section that is meshed with the gear.

14 Claims, 5 Drawing Sheets

(58) Field of Classification Search
CPC ..... F16H 19/04; F16H 19/043; F16H 19/26; F15B 15/065
USPC ..... 74/89.17, 109
See application file for complete search history.

(56) References Cited

U.S. PATENT DOCUMENTS

| | | | | |
|---|---|---|---|---|
| 8,869,437 | B2 | 10/2014 | Robl et al. | |
| 2001/0029796 | A1* | 10/2001 | Magaribuchi | F16H 19/04 74/89.17 |
| 2003/0131505 | A1* | 7/2003 | Heiple | E02F 3/3636 37/468 |
| 2009/0235561 | A1* | 9/2009 | Muller | E02F 3/3654 37/468 |
| 2010/0232919 | A1 | 9/2010 | Calvert | |
| 2011/0280648 | A1 | 11/2011 | Malacrino et al. | |
| 2017/0350090 | A1* | 12/2017 | Claesson | A01B 59/06 |

FOREIGN PATENT DOCUMENTS

| | | | |
|---|---|---|---|
| DE | 4109783 | A1 | 9/1991 |
| EP | 3009570 | A1 | 4/2016 |
| JP | 2009-052402 | A | 3/2009 |
| WO | WO 90/08234 | A1 | 7/1990 |
| WO | WO 2016/059328 | A1 | 4/2016 |

* cited by examiner

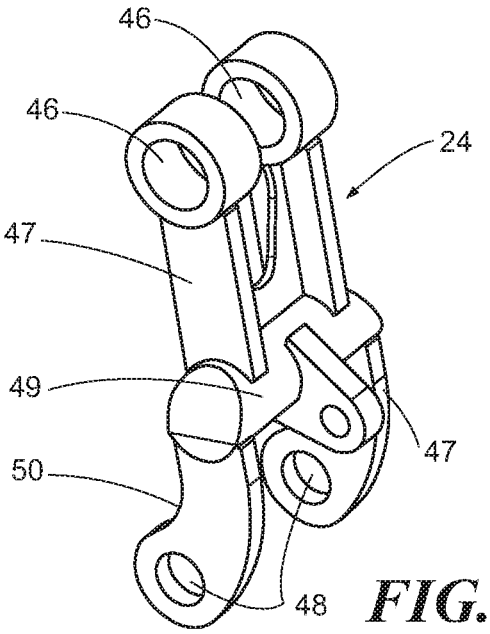
FIG. 2A
FIG. 2B
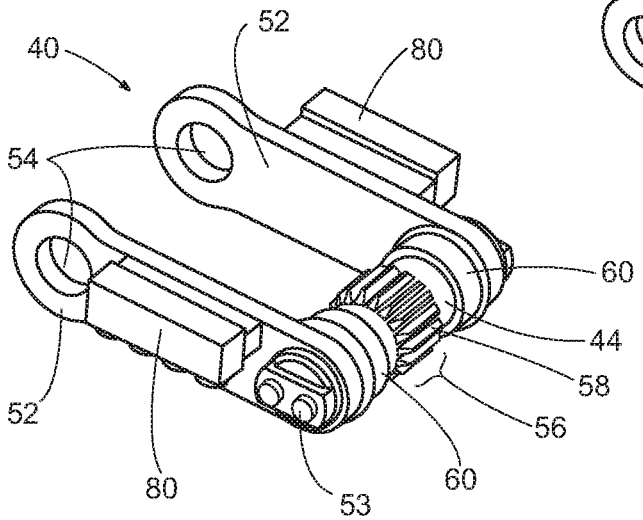
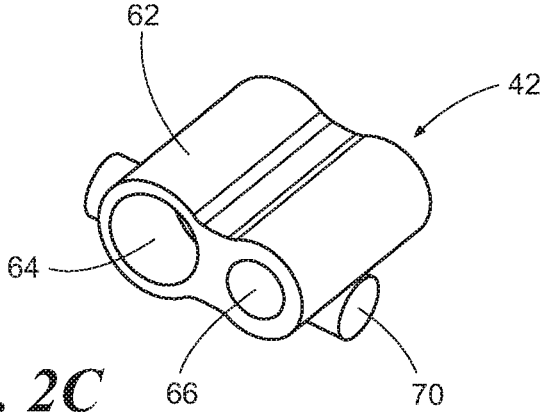
FIG. 2C

COUPLER ASSEMBLY FOR COUPLING AN ARM TO A WORK TOOL

CROSS-REFERENCE TO RELATED APPLICATION

This application claims priority under 35 USC § 119 and the Paris Convention to European Application No. 17181961.7 filed on Jul. 25, 2017.

TECHNICAL FIELD

The present disclosure relates to a coupler assembly for detachably coupling an arm to a work tool.

BACKGROUND

Couplers are commonly used for detachably connecting work tools such as buckets, pulveriser jaws, hammers, and grapples, to arms of primary movers such as backhoes, excavators, and loaders. Couplers may allow a machine operator to quickly change from one work tool to another. Couplers typically include an actuator that selectively moves one or more locking pins into engagement with the work tool.

The locking pins may be subjected to external forces during use of the work tool, which may include compressive forces. In couplers known in the art these compressive forces may result in the work tool accidentally disengaging from the arm.

Couplers add to the weight of the arm and work tool, which may reduce the working capacity of the work tool, particularly of buckets and grapples. For this reason, it is generally considered desirable in the art for couplers to have a low weight. However, low weight may be secondary to safety considerations in providing a coupler that resists compressive forces in use and remains attached to the work tool.

PCT patent publication WO2016/059328A1 describes a tool holder for coupling a work tool to an arm. The tool holder has a linkage having an idle link attached to the arm and a power link. Gripping pins are provided on the arm and at one end of the power link. A hydraulic ram is provided between the gripping pins on the arm and the gripping pins on the power link. The hydraulic ram is extendible to move the gripping pins closer together or further apart in order to release or engage openings on the work tool.

SUMMARY OF THE DISCLOSURE

In an aspect of the present disclosure, a coupler assembly for detachably coupling an arm to a work tool is provided. The coupler assembly comprises a first linkage having an idle link and a power link. A first attachment member provided on the arm and a second attachment member provided on the power link. The first and second attachment members are receivable in corresponding openings on the work tool. The coupling assembly is characterized by a second linkage provided between the first and second attachment members, comprising a first link and a second link joined at a shaft. The first link is fixed to the shaft to prevent rotation therebetween. A portion of the shaft comprises a gear. The second link comprises a body mounted on the shaft so as to be rotatable thereabout, the body comprising a chamber in which a piston is received, the piston including a geared section that is meshed with the pinion gear.

Other features and aspects of this disclosure will be apparent from the following description and the accompanying drawings.

BRIEF DESCRIPTION OF THE DRAWINGS

FIG. 2A shows the power link of the coupler assembly of FIG. 1;

FIGS. 2B and 2C show components of the second linkage of the coupler assembly of FIG. 1 in partially disassembled form;

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts.

Figure 1:
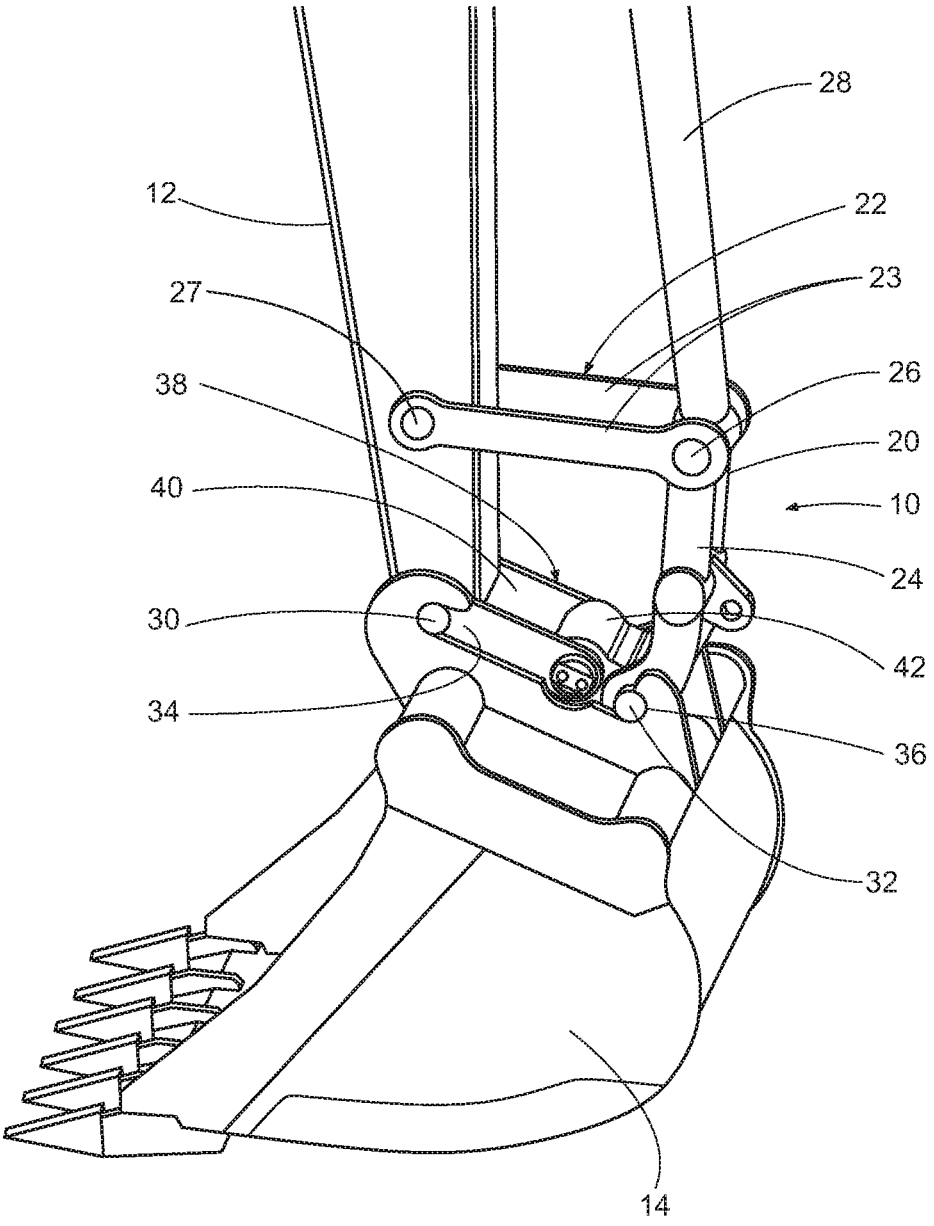
FIG. 1 shows a work tool detachable coupled to an arm using a coupler assembly according to embodiments of the present disclosure.

FIG. 1 shows a coupler assembly 10 for detachably coupling an arm 12 of a primary mover to a work tool 14 according to embodiments of the present disclosure. The work tool 14 illustrated in FIG. 1 is a bucket, however the coupler assembly 10 may be used to detachably couple the arm 12 to other forms of work tools known to those skilled in the art, including pulveriser jaws, hammers, and grapples to name a few.

The coupler assembly 10 comprises a first linkage 20 comprising an idle link 22 and a power link 24. The idle link 22 and the power link 24 are connected at a joint 26 about which the idle link 22 and the power link 24 may rotate. The idle link 22 is rotatably mounted to the arm 12 at a further joint 27. In the illustrated embodiment shown in FIG. 1 the idle link 22 may comprise a pair of link members 23 arranged in a spaced apart configuration, although in other embodiments the idle link 22 may take other forms known to those in the art such as a single link member. An actuator, which may be a hydraulic cylinder having a piston rod 28, extends between the arm 12 and the joint 26.

A first attachment member 30 is provided on the arm 12, and a second attachment member 32 is provided on the power link 24 remote from the joint 26. In the illustrated embodiment shown in FIG. 1 the first and second attachment members are pins, however other suitable attachment members known to those skilled in the art may be used in other embodiments. The first and second attachment members 30, 32 are receivable in corresponding first and second openings 34, 36 provided on the work tool 14 to couple the arm 12 to the work tool 14.

The coupler assembly 10 further comprises a second linkage 38 provided between the first and second attachment members 30, 32. The second linkage 38 comprises a first link 40 and a second link 42 joined at a shaft 44.

Referring now to FIG. 2A-2C, the second linkage 38 and power link 24 are shown in disassembled form for clarity. The power link 24, as illustrated in FIG. 2A, may include apertures 46, 48 which may be provided near opposed ends of the power link 24. The aperture 46 may be for receiving a pin forming the joint 26. The aperture 48 may be for receiving a pin forming the second attachment member 32. The power link 24 may include a curved section 50 near the aperture 48 that may extend an angular range through which the coupler assembly 10 may travel by preventing the power link 24 from impacting the second linkage 38. The power link 24, as illustrated in FIG. 2A, may include spaced apart structural members 47 connected by a cross-member 49 to form an H-shape in which the apertures 46, 48 are formed at the ends of the structural members 47. In other embodiments, other suitable configurations of the power link 24 known to those in the art may be adopted.

The first link 40, as illustrated in FIG. 2B, may comprise a pair of members 52. The first link 40 is fixed to the shaft 44 to prevent rotation between the members 52 and the shaft 44. Each member 52 may have an aperture 54 formed therein, remote from the shaft 44, in which the first attachment member 30 may be received to rotatably mount the first link 40 to the first attachment member 30. Each member 52 may be fixed to opposed ends of the shaft 44 by fasteners 53.

A portion 56 of the shaft 44 comprises a gear 58, which may be provided generally centrally on the shaft 44. The shaft 44 may further comprise two bearing and seals 60, one provided at adjacent each end of the shaft 44 inwardly of the members 52.

The second link 42, as illustrated in FIG. 2C, comprises a body 62 which may have first and second openings 64, 66, provided therein. The first and second openings 64, 66 may be provided adjacent opposed ends of the body 62. The first opening 64 may extend through the body 62 and may be configured to receive the shaft 44 therein. In this manner, the second link 42 may be mounted on the shaft 44 so as to be rotatable thereabout. The bearing and seals 60 may engage with the body 62 to form a seal therewith and permit rotation of the body 62 about the shaft 44. The second opening 66 may extend through the body 62 and be configured to receive the second attachment member 32 therein to rotatably mount the second link 42 to the second attachment member 32.

The body 62 further comprises a chamber 68 which may be provided in a column 70. The column 70 may extend along the body 62 generally perpendicular to the direction of the first opening 64 such that the chamber 68 is perpendicular to the shaft 44.

Figure 3:
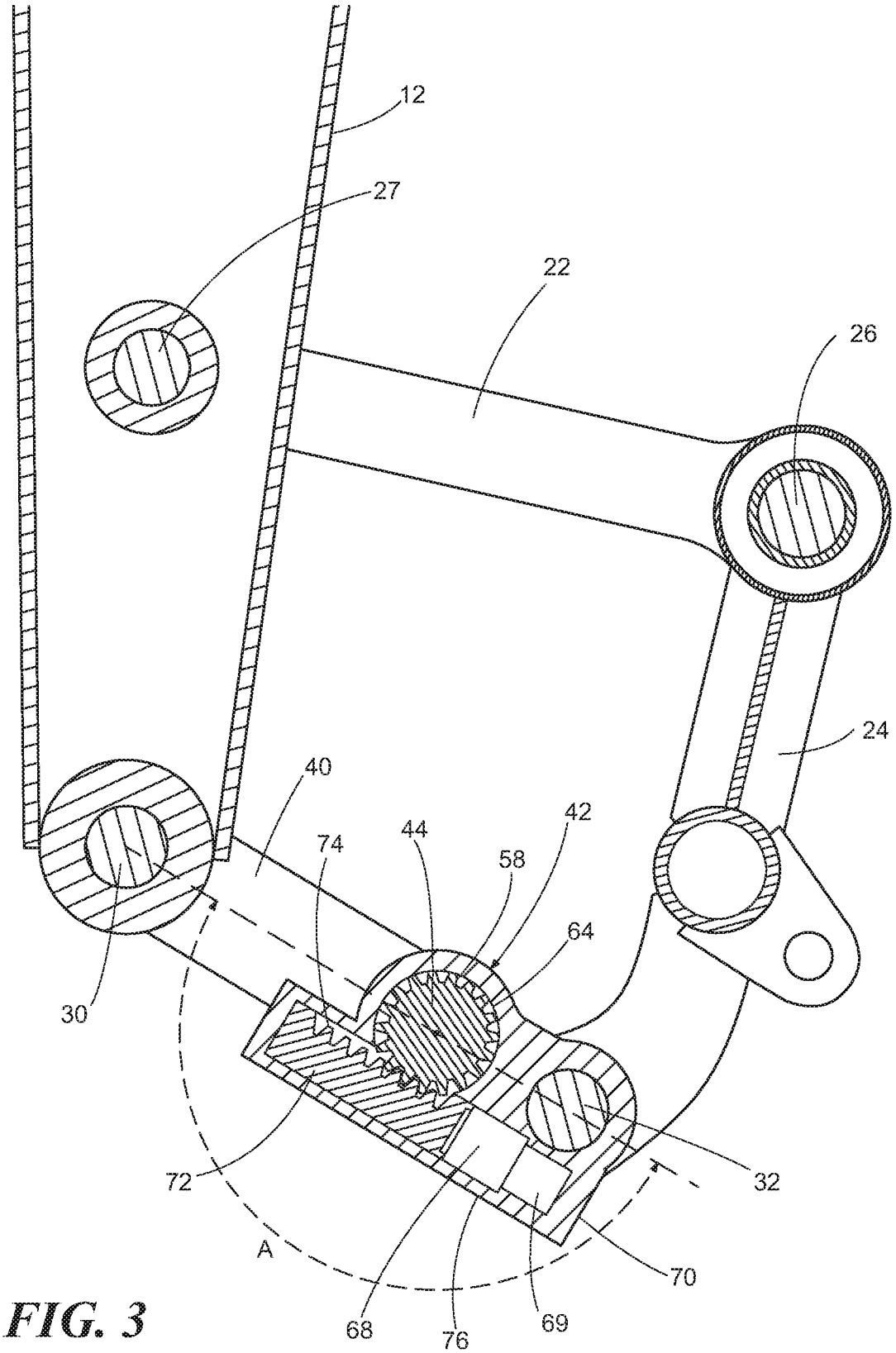
FIG. 3 shows the arm and coupler assembly in FIG. 1, in cross-section view, with the coupler assembly in an engaged configuration.

As seen in FIG. 3, a piston 72 having a geared section 74 is received in the chamber 68. The chamber 68 intersects with the first opening 64 such that the geared section 74 of the piston 72 meshes with the gear 58 formed on the shaft 44. The chamber 68 and column 70 may be formed on a side 76 of the body 62 that faces the work tool 14 when the arm 12 is coupled to the work tool 14.

The piston 72 is movable within the chamber 68 between a first position and a second position. As the piston 72 moves within the chamber 68 the geared section 74 of the piston 72 meshing with the gear 58 formed on the shaft 44 causes the body 62 of the second link 42 to rotate about the shaft 44.

Figure 4:
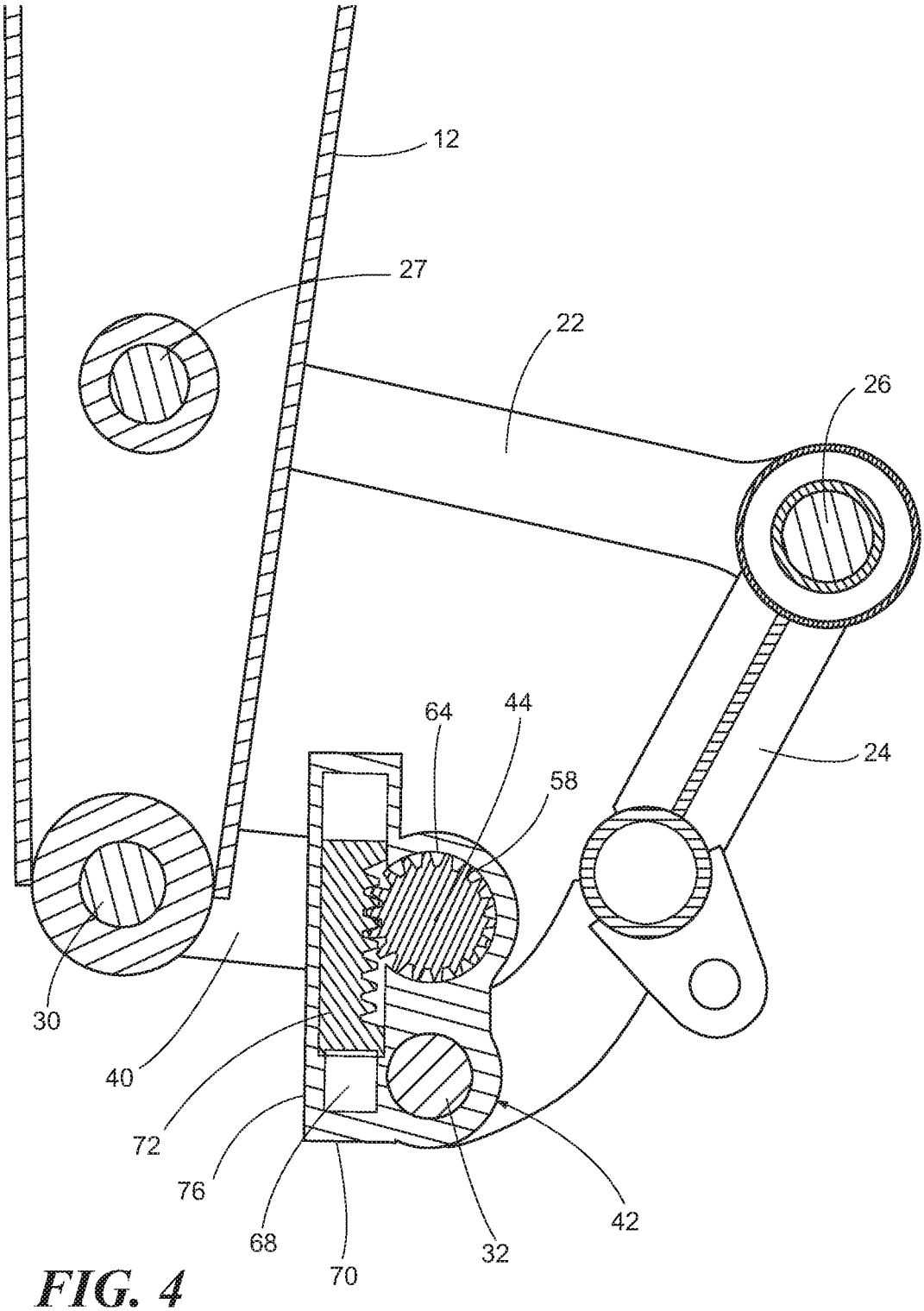
FIG. 4 shows the arm and coupler assembly in FIG. 1, in cross-section view, with the coupler assembly in a disengaged configuration.

When the piston 72 is in the first position, the first and second attachment members 30, 32 may be in a disengaged configuration, as illustrated in FIG. 4. The disengaged configuration may correspond with the first and second attachment members 30, 32 being spaced apart a distance less than the distance between the openings 34, 36 on the work tool 14 so that the coupler assembly 10 may be decoupled from the work tool 14.

When the piston 72 is in the second position, the first and second attachment members 30, 32 may be in an engaged configuration, as illustrated in FIG. 3. The engaged configuration may correspond with the first and second attachment members 30, 32 being spaced apart a distance corresponding to the distance between the openings 34, 36 on the work tool 14. In this manner, the coupler assembly 10 may be coupled to the work tool 14 as the first and second attachment members 30, 32 are received within the openings 34, 36 on the work tool 14.

The chamber 68 may be a double-acting hydraulic cylinder to provide motive force to the piston 72. Inlet and outlets (not shown) for hydraulic fluid have been omitted from the drawings for clarity. In some embodiments, a resilient member (not shown) such as a spring, coil, or piece of resilient material may be provided at one end 69 of the chamber 68 to bias the piston 72 toward the second position. The piston 72 is shown in FIG. 3 in the second position.

As seen from FIG. 3, the second position of the piston 72 corresponds with the first and second links 40, 42 being substantially parallel, such that an angle A between the first link 40 and the second link 42 corresponds with 180°. The rotational mechanism provided by the piston 72 and the gear 58 on the shaft 44 may provide a mechanical advantage compared to a linear actuator extending directly between the first and second attachment members 30 and 32 as is common in the art, and may result in a more secure coupling to work tool 14 which resists accidental decoupling from compressive forces during use. A force with which the first and second attachment members 30 and 32 are forced apart and into engagement with the work tool 14 may be referred to as a coupling force. The mechanical advantage provided by the piston 72 and gear 58 may require a smaller hydraulic cylinder to provide the same coupling force as a linear actuator extending directly between the first and second attachment members 30 and 32, which may result in a lighter coupler assembly 10.

In some embodiments, the coupler assembly 10 may be used with an arm 12 having the same configuration as an arm that is directly coupled to a work tool. This may have benefits in manufacturing, since multiple arm designs may not be necessary, reducing manufacturing costs. In some embodiments, the first attachment member may be provided on the arm 12 in the same location as a coupling pin is provided on an arm that is directly coupled to a work tool. Further, the idle link 22 of the coupler assembly may be the same as an idle link provided on an arm that is directly coupled to a work tool. Still further, the power link 24, first link 40 and second link 42 may be configured so that, when the piston 72 is in the second position, the location of the second attachment member 32 corresponds with a second coupling point between a work tool and an arm to which it is directly coupled. Such a configuration may provide the work tool 14 with similar kinematics to a work tool directly coupled to an arm and may avoid a reduction in operating load associated with prior art couplers.

Referring now to FIG. 2B, a first part 80 of a hydraulic connector may be provided on the first link 40. The first part 80 is configured to mate with a second part (not shown) of the hydraulic connector that may be provided on the work tool when the first and second attachment members are in an engaged position. The hydraulic connector may permit one or more hydraulic fluid connections to the work tool, for instance to provide hydraulic fluid to a hammer or pulveriser. Alignment between the first and second parts of the hydraulic connector may be assisted by the rotational movement of the first link about the first attachment point 30 on the arm 12. With the first attachment member 30 received in the first opening 34 on the work tool 14, rotational movement of the first link 40 as the piston 72 is moved from the first position to the second position may bring the first part 80 into alignment with the second part of the hydraulic connector provided on the work tool 14.

In some embodiments, the coupler assembly 10 may be configured such that when the piston 72 is in the second position and the first and second attachment members 30, 32 are in the engaged position, the angle A may be a reflex angle, i.e. more than 180°. Such a configuration may provide additional protection against accidental decoupling of the work tool 14 from the arm 12 since external compression of the second linkage may be constrained by the body 62, such as the column 70 thereof, contacting the work tool 14.

Figure 5:
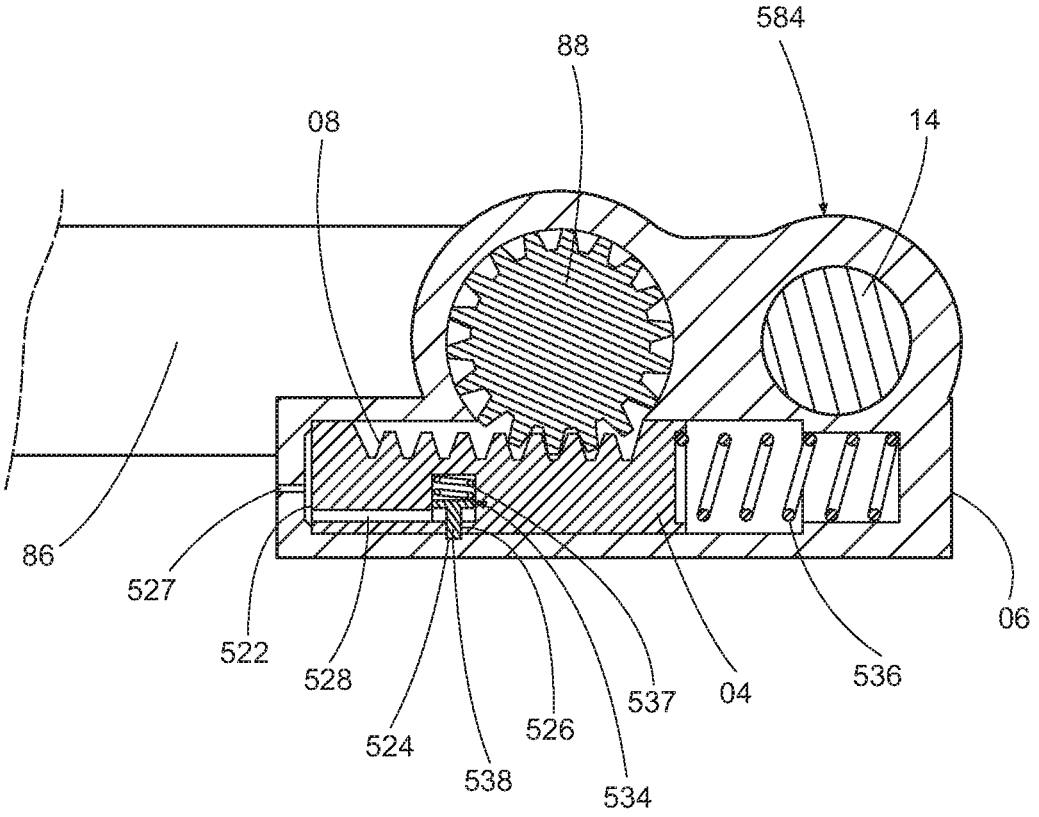
FIG. 5 shows a second linkage in cross section according to a further embodiment of the present disclosure.

Referring now to FIG. 5, an enlarged cross-sectional view of a second link 142 according to further embodiments of the present disclosure is shown. The second link 142 is of the same general form as the second link 42 described above and like reference numerals are used to denote like parts.

The second link 142 is provided with a resilient member in form of a spring 150 at one end 69 of the chamber 68 to bias the piston 72 towards the second position. In some embodiments, the chamber 68 may by a single acting hydraulic cylinder in which the spring 150 acts to return the piston 72 to the second position in the absence of hydraulic fluid pressure. In other embodiments, the chamber 68 may be a double-acting hydraulic cylinder where the spring 150 provides a safety mechanism to maintain the coupler assembly 10 engaged with a work tool 14 in the event of loss of hydraulic fluid to the chamber 68.

The piston 72 shown in FIG. 5 may be provided with a locking mechanism 152, comprising a bolt 154 provided in a cavity 156 formed in the piston 72. The bolt 154 may be biased by a resilient member such as a spring 158 to urge the bolt 154 through an aperture 160 formed in the piston 72. The aperture 160 may align with a recess 162 formed in the chamber 68 when the piston 72 is in the second position, whereby the bolt 154 may extend into the recess 162 to hold the piston 72 at the second position, as shown in FIG. 5. The locking mechanism 152 may act as a safety measure that maintains the coupler assembly 10 engaged with a work tool 14 in the event of loss of hydraulic fluid to the chamber 68. The locking mechanism 152 may act in combination with the spring 150, whereby in the event of loss of hydraulic fluid to the chamber 68 the spring 150 may bias the piston 72 towards the second position, at which position the bolt 154 may extend into the recess 162 in the chamber 68 to hold the piston 72 in the second position.

A conduit 164 may be formed in the piston 72 which extends from one end 166 thereof to the cavity 156. Hydraulic fluid may enter the chamber 68 via an opening 168 in the column 70 near the one end 166 of the piston 72. The hydraulic fluid may enter the conduit 164 and into the cavity 156 and bear against a flange 170 on the bolt 154 to retract the bolt 154 into the cavity 156 and permit movement of the piston 72 towards the first position.

INDUSTRIAL APPLICATION

The present disclosure provides a coupler assembly 10 for detachably coupling an arm 12 to a work tool 14. The coupler assembly 10 is applicable to machines such as primary movers.

What is claimed is:

1. A coupler assembly for detachably coupling an arm to a work tool, the coupler assembly comprising a first linkage having an idle link and a power link, a first attachment member provided on the arm, and a second attachment member provided on the power link, the first and second attachment members being receivable in corresponding openings on the work tool, the coupling assembly characterized by:

a second linkage provided between the first and second attachment members, comprising a first link and a second link joined at a shaft;

the first link being fixed to the shaft to prevent rotation therebetween;

wherein a portion of the shaft comprises a gear;

wherein the second link comprises:

a body mounted on the shaft so as to be rotatable thereabout, the body comprising a chamber in which a piston is received, the piston including a geared section that is meshed with the gear, wherein the piston is movable between a first position in which the first and second attachment members are in a disengaged configuration with an angle between the first link and the second link being less than 180°, and a second position in which the first and second attachment members are in an engaged position with the angle between the first link and the second link being at least 180°.

2. The coupler assembly of claim 1, wherein the second position corresponds with the first and second links being substantially in-line with one another.

3. The coupler assembly of claim 1, wherein the chamber is formed in the body on a side thereof facing the work tool when the arm is coupled to the work tool.

4. The coupler assembly of claim 3, wherein when the first and second attachment members in the engaged position, the angle is, a reflex angle of more than 180°formed between the first link and the second link of the second linkage wherein external compression of the second linkage forcing the first and second attachment members, toward each other is constrained by the body contacting the work tool.

5. The coupler assembly of claim 1, wherein a resilient member is provided in the chamber to bias the piston toward the second position.

6. The coupler assembly of claim 1, wherein chamber is double-acting hydraulic cylinder.

7. The coupler assembly of claim 1, wherein the first and second attachment members are pins.

8. The coupler assembly of claim 7, wherein the body is mounted on the second pin so as to be rotatable thereabout.

9. The coupler assembly of claim 7, wherein the first link is mounted on the first pin so as to be rotatable thereabout.

10. The coupler assembly of claim 1, wherein a first part of a hydraulic connector is provided on the first link, the first part being configured to mate with a second part of the hydraulic connector that is provided on the work tool when the first and second attachment members are in an engaged position.

11. The coupler assembly of claim 1, wherein the chamber is perpendicular to the shaft.

12. The coupler assembly of claim 1, wherein the piston further comprises a locking mechanism to hold the piston at the second position.

13. The coupler assembly of claim 12, wherein the locking mechanism comprises a bolt provided in the piston that is receivable in a recess formed in the chamber.

14. A primary mover comprising an arm and a coupler assembly of claim 1.

* * * * *